US006561270B1

(12) United States Patent
Budde

(10) Patent No.: US 6,561,270 B1
(45) Date of Patent: May 13, 2003

(54) PLUG AND PLUG SET FOR USE IN WELLBORE

(75) Inventor: Peter Budde, Vlaardingen (NL)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/786,530

(22) PCT Filed: Sep. 10, 1999

(86) PCT No.: PCT/GB99/03015

§ 371 (c)(1),
(2), (4) Date: Mar. 6, 2001

(87) PCT Pub. No.: WO00/15944

PCT Pub. Date: Mar. 23, 2000

(30) Foreign Application Priority Data

Sep. 12, 1998 (GB) ..... 9819795

(51) Int. Cl.[7] ..... E21B 33/16; E21B 43/00
(52) U.S. Cl. ..... 166/153; 166/177.4
(58) Field of Search ..... 166/153, 155, 166/156, 177.4, 291

(56) References Cited

U.S. PATENT DOCUMENTS

| | | | | |
|---|---|---|---|---|
| 1,527,749 A | | 2/1925 | Raymond | |
| 1,803,057 A | | 4/1931 | Dyer | |
| 1,994,072 A | | 3/1935 | Hardcastle | |
| 2,717,645 A | | 9/1955 | Schnitter | 166/156 |
| 3,939,519 A | | 2/1976 | Muirhead | |
| 4,378,838 A | | 4/1983 | Ogden et al. | 166/153 |
| 4,671,358 A | | 6/1987 | Lindsey et al. | 166/291 |
| 4,836,279 A | * | 6/1989 | Freeman | 166/153 |
| 4,979,562 A | | 12/1990 | Langer | |
| 5,095,980 A | * | 3/1992 | Watson | 166/153 |
| 5,234,052 A | | 8/1993 | Coone et al. | 166/155 |
| 5,433,270 A | * | 7/1995 | LaFleur | 166/152 |
| 5,762,139 A | | 6/1998 | Sullaway et al. | 166/291 |
| 6,237,686 B1 | * | 5/2001 | Ryll et al. | 166/153 |

FOREIGN PATENT DOCUMENTS

| | | | |
|---|---|---|---|
| EP | 0 498 990 A1 | 8/1992 | E21B/33/16 |
| SU | 1 673 727 A1 | 8/1991 | E21B/33/16 |
| WO | 94/15062 | 7/1994 | E21B/33/16 |
| WO | 96/34175 | 10/1996 | E21B/33/16 |

* cited by examiner

*Primary Examiner*—David Bagnell
*Assistant Examiner*—Brian Halford
(74) *Attorney, Agent, or Firm*—Moser, Patterson & Sheridan, L.L.P.

(57) ABSTRACT

A plug for use in a wellbore, said plug (201; 301) having a body with an upstream end and a downstream end, characterized in that a major portion of the length of said body is hollow and open to the upstream end of said plug. A plug set for use in a wellbore, said plug set comprising a top plug and a bottom plug, characterized in that a major portion of the volume of said bottom plug is hollow and a major portion of the length of said top plug can be accommodated therein. A plug for use in a wellbore, said plug comprising a body and at least a first fin which is made of resilient material and which projects radially outwardly from said body to engage, in use, the inner wall of a tubular, characterized in that said first fin is segmented and is provided with means to inhibit liquid passing through the gaps between said segment. The body and fin(s) of the plug can be made as a one piece injection moulding. Alternatively, the plug may be of modular construction, each module comprising a body part and a fin and each module being separately injection moulded.

37 Claims, 5 Drawing Sheets

FIG. 3
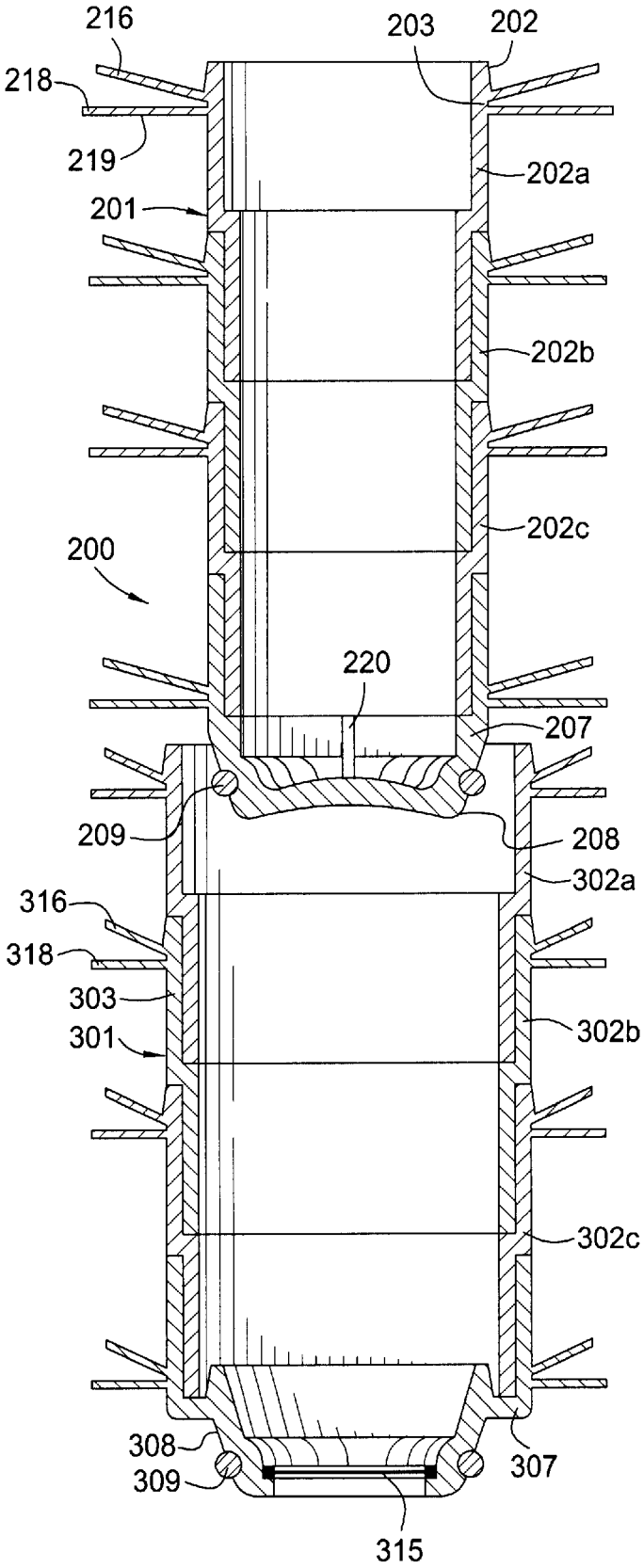
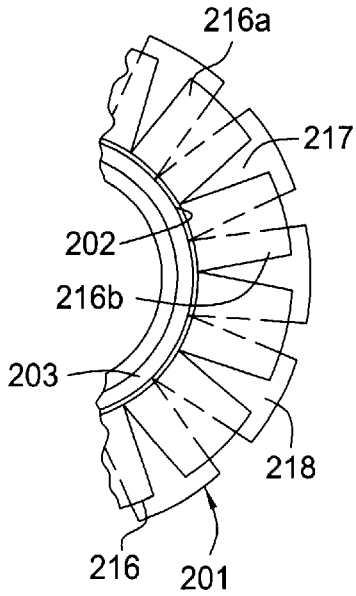
FIG. 4

PLUG AND PLUG SET FOR USE IN WELLBORE

This invention relates to a plug and a plug set for use in a wellbore.

During the construction of oil and gas wells a borehole is drilled in the ground. A casing string is then lowered down the borehole and the annular space between the casing and the borehole filled with cement.

In order to facilitate cementation a float shoe and/or a float collar is inserted in or adjacent the bottom of the casing.

At the commencement of the cementation process fluid is pumped down the casing and allowed to flow through the annular space between the casing and the borehole. The fluid is introduced to remove any debris from the annular space and clean the outside of the casing. This process is often referred to as "circulation".

After circulation is complete, which typically takes several hours, a bottom plug is inserted into the casing and pumped down the casing by cement. After sufficient cement has been introduced into the casing a top plug is inserted into the casing and the column of cement, bounded by the top plug and the bottom plug, is pumped down the casing by drilling mud until the bottom plug lands on the float shoe. When the bottom plug lands on the float shoe the pressure on the top plug is increased until a diaphragm in the bottom plug ruptures thereby allowing the cement to pass through the float shoe and/or float collar and flow around the bottom of the casing and upwardly through the annular space between the casing and the wellbore.

When the top plug lands on the bottom plug the casing is immediately pressure tested by increasing the pressure of the drilling mud to the test pressure and, after stopping the pumps, checking to see whether any drop in pressure in a given time exceeds a design limit.

Once the test is completed the pressure inside the casing is relaxed and the cement (which is still wet) is allowed to set. The float shoe and/or float collar are essentially check vales which allow the flow of cement from the inside of the casing to the annular space between the casing and the borehole whilst inhibiting return flow therethrough.

After the cement has set the top plug, bottom plug and any cement set in the casing are drilled out before extending the borehole.

Conventionally, top plugs and bottom plugs have been extremely sturdy and massive construction.

One well accepted plug is described and shown in applicants' PCT Patent Publication No. WO 94/15062. As can be seen from this publication the plug comprises a central core of hard, drillable polyurethane surrounded by a relatively flexible outer sheath having a plurality of fins extending therefrom. The top fin is extremely sturdy and is designed to withstand a pressure of typically 11,400 psi (780 bar).

The central core of the bottom plug is designed to withstand the pressure applied to the top plug.

Whilst these plugs have performed very acceptably they are not without their problems. In particular, they are relatively heavy and expensive. Furthermore, there is a tendency for the plugs to wobble as they travel downhole.

In the case of the bottom plug this can result in the bottom plug not landing properly on the float valve or collar. When the diaphragm bursts the overlap between the opening in the bottom plug and the opening in the float collar can reduct flow through the float valve thereby prolonging the cementing operation.

In the case of the top plug, if this does not land properly on the bottom plug and ends up skewed in the casing the upstream fin will not seal. This usually prevents the well being pressure tested since any attempt to pressurise the drilling mud above the top plug results in the drilling mud leaking, past the top plug, passing through the hole in the bottom plug and the float valve and entering fissures in the borehole or extruding the annulus of cement upwardly, which is highly undesirable.

Dealing firstly with the alignment problem, the tops of prior art plugs are generally substantially planar with the consequence that they are generally pushed down a wellbore from behind. The applicants believe that this is largely responsible for the wobble. A possible analogy is pushing a bicycle by holding the saddle. It will be appreciated that this is quite difficult as the front wheel tends to move away from the intended direction of travel, particularly if it encounters a stone or similar obstruction on the ground (corresponding to mud cake on the wall of casing). If the bicycle is steered from the front handlebars then the saddle follows.

By analogy, the Applicants submit that if a top plug is pushed from a position at or adjacent the downstream end thereof the upstream portion will follow and the chances of the plug being misaligned when it lands are reduced.

According to a first aspect of the present invention there is provided a plug for use in a wellbore, said plug comprising a body and at least a first fin which is made of a resilient material and which projects radially outwardly from said body to engage in use, the inner wall of a tubular, characterised in that said first fin is segmented and is provided with means to inhibit liquid passing through the gap between said segments.

In its simplest form said means may be provided by an extension piece integral with or attached to each segment. However, said means preferably comprises a second fin which is mounted downstream of said first fin and is segmented in such a way that, in use, said segments in said second fin engage said segments in said first fin and overlap the gaps therebetween.

If desired further segmented fins may be provided. Preferably, the segments of the first fin are mounted to pivot about a line which is disposed radially outwardly of a line about which the segments of said second fin pivots. This helps ensure that the segments of the second fin effectively engage the segments of the first fin.

Advantageously, the radial extremities of the segments of the second fin are provided with means which, in use, facilitate the removal of mud cake from the inside of casing. Such means may comprise, for example, ribs or protrusions on the radial extremity of at least some of the segments or even forming an angled surface on the radial extremity of the segments which acts like a chisel as the plug passes through a tubular.

By suitably dimensioning the segments it is conceivable that a very strong fin could be formed. However, in the context of the preferred embodiment it is anticipated that the fins will have a thickness of less than 3 mm.

Plugs in accordance with the present invention lend themselves to production in one piece particularly by injection moulding.

A suitable moulding material would be a polyamide, for example a polyamide currently sold under the trademark "!!PETER!!" by BASF of Germany.

It will be appreciated that a one piece injection moulding is far less expensive than the two stage moulding previously used in the production of conventional plugs.

The preferred embodiment satisfies certain needs which are now emerging. In particular, because of the greater depths of modern wells and the greater radial reach of many wells, it is becoming increasingly difficult to ensure that the cement is in a usable state by the time it reaches the bottom of the casing (or liner). In particular, it can take two hours for the bottom plug to travel from the surface to the float collar. If the bottom plug does not align properly with the float collar then the flow rate of the cement through the float collar can be restricted to such an extent that the cement passes through its "first set" before reaching the annulus.

High capacity float valves are being developed to reduce this problem. However, another solution is to use special chemical mixtures which precede and follow the slug of cement. These chemicals are strong solvents and tend to dissolve rubber which is most commonly used in the construction of plugs. Furthermore, such chemicals are particularly effective solvents at high temperatures.

Whilst the preferred materials of the present invention are, in their own right, resistant to chemical attack at high temperatures we have found that a plug having a body and fins formed in one piece by injection moulding has outstanding characteristics.

According to a second aspect of the present invention there is provided a plug for use in a wellbore, said plug having a body with an upstream end and a downstream end, characterised in that a major portion of the length of said body is hollow and open to the upstream end of said plug.

The plug may be a top plug, a bottom plug or an intermediate plug. In the case of the bottom plug or the intermediate plug a bursting disk or similar rupturable membrane will be provided at or adjacent the downstream end of the plug.

Advantageously, the major portion of the volume of said body is hollow and open to the upstream end of said plug.

It will be noted that by increasing the volume of the hollow portion of the plug the total amount of material required to manufacture the plug is reduced and the cost of manufacturing and transporting the plug reduced accordingly. However, using conventional concepts it is still important that the bottom plug should be able to support the top plug, the bodies of which are of equal diameter.

According to a third aspect of the present invention there is provided a plug set for use in a wellbore said plug set comprising a top plug and a bottom plug, characterised in that a major portion of the volume of said bottom plug is hollow and a major portion of the length of said top plug can be accommodated therein.

Advantageously, a major portion of the length of said top plug is hollow and open to the upstream end of said top plug.

Preferably, the downstream end of the bottom plug is provided with a nose which is preferably tapered and which can be received in a correspondingly tapered entrance to a float shoe or float collar. The nose is preferably provided with a seal to sealingly engage in the tapered entrance to the float valve.

In a similar manner the top plug is preferably provided with a tapered nose which can enter the tapered nose of the bottom plug and seat thereon. The tapered nose is preferably provided with a seal to facilitate the making of a seal between the tapered nose on the top plug and the tapered nose on the bottom plug.

By adopting this nesting construction the need for a strong core disappears. Typically, after a prior art cementing operation is complete and the cement set the top plug and the bottom plug are drilled out. This typically takes 15 minutes which is extremely expensive when it is recalled that a large offshore platform can cost over $1,000,000 a day to operate. In contrast, the nested top plug and bottom plug described above offer negligible resistance to the immense weight and power of a large drill which will simply pass through the nested top plug and bottom plug before drilling out the float collar and/or float shoe and any cement therebelow before drilling onwards.

The next area of investigation is the fin design. As indicated above the upstream fin on conventional plugs is usually massive. This is because the top of the top plug forms the platform on which the casing is pressure tested. The top plug itself must be supported by a substantial bottom plug which rests on the float collar or shoe.

If the upstream fin is not required to perform such an onerous duty then the design of the fin can be changed.

According to a fourth aspect of the present invention there is provided a plug for use in a wellbore, said plug comprising a body and fins, characterised in that said body and fins are formed in one piece by injection moulding.

For a better understanding of the present invention, reference will now be made, by way of example, to the accompanying drawings in which:

FIG. 3 is a section through a plug set in accordance with the present invention;

FIG. 4 is a plan view of a detail of the top plug of the plug set shown in FIG. 3;

Figure 1:
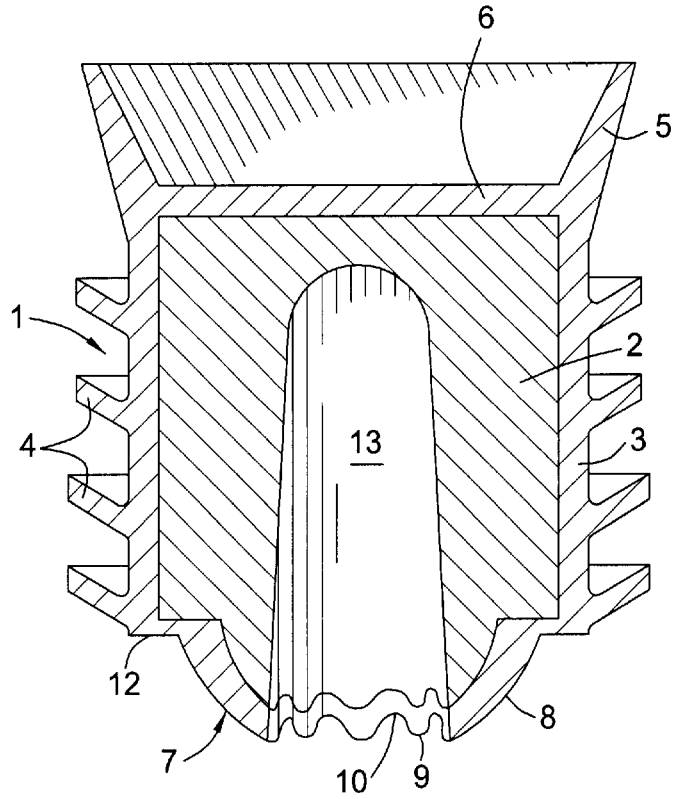
FIG. 1 (PRIOR ART)
FIG. 1 is a section through a prior art top plug.

Referring to FIG. 1 of the drawings, there is shown a known top plug which is described in detail in PCT Patent Publication No. WO 94/15062. The top plug, which is generally identified by reference numeral 1 comprises a body comprising a core 2 of rigid polyurethane in an outer casing 3 of elastic polyurethane. The outer casing 3 includes a plurality of wipers 4, a sealing fin 5 and a top 6.

The top plug 1 includes an anti-rotation device in the form of a tapered male member 7 which has a corrugated outer surface comprising alternate mounds 9 and recesses 10.

The tapered male member 7 is surrounded by an annular load bearing and sealing surface 12.

The core 2 is provided with a cavity 13 which reduces the overall weight of the top plug 1 and facilitates drilling out of the top plug 1 after use. It will be noted that the cavity 13 opens into the downstream end of the plug 1.

Figure 2:
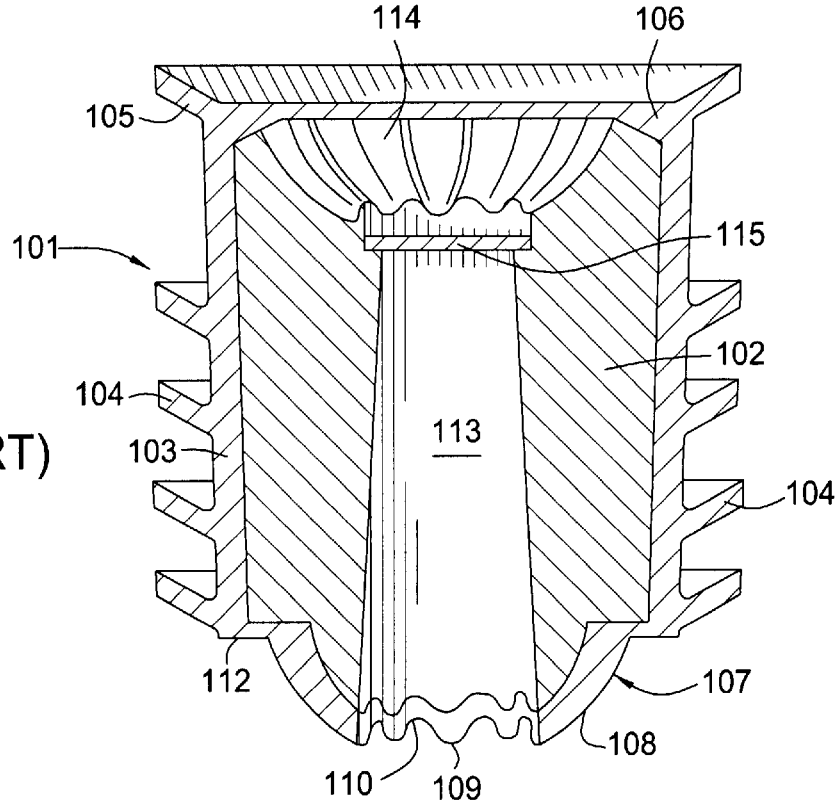
FIG. 2 (PRIOR ART)
FIG. 2 is a section through a prior art bottom plug.
Figure 5:
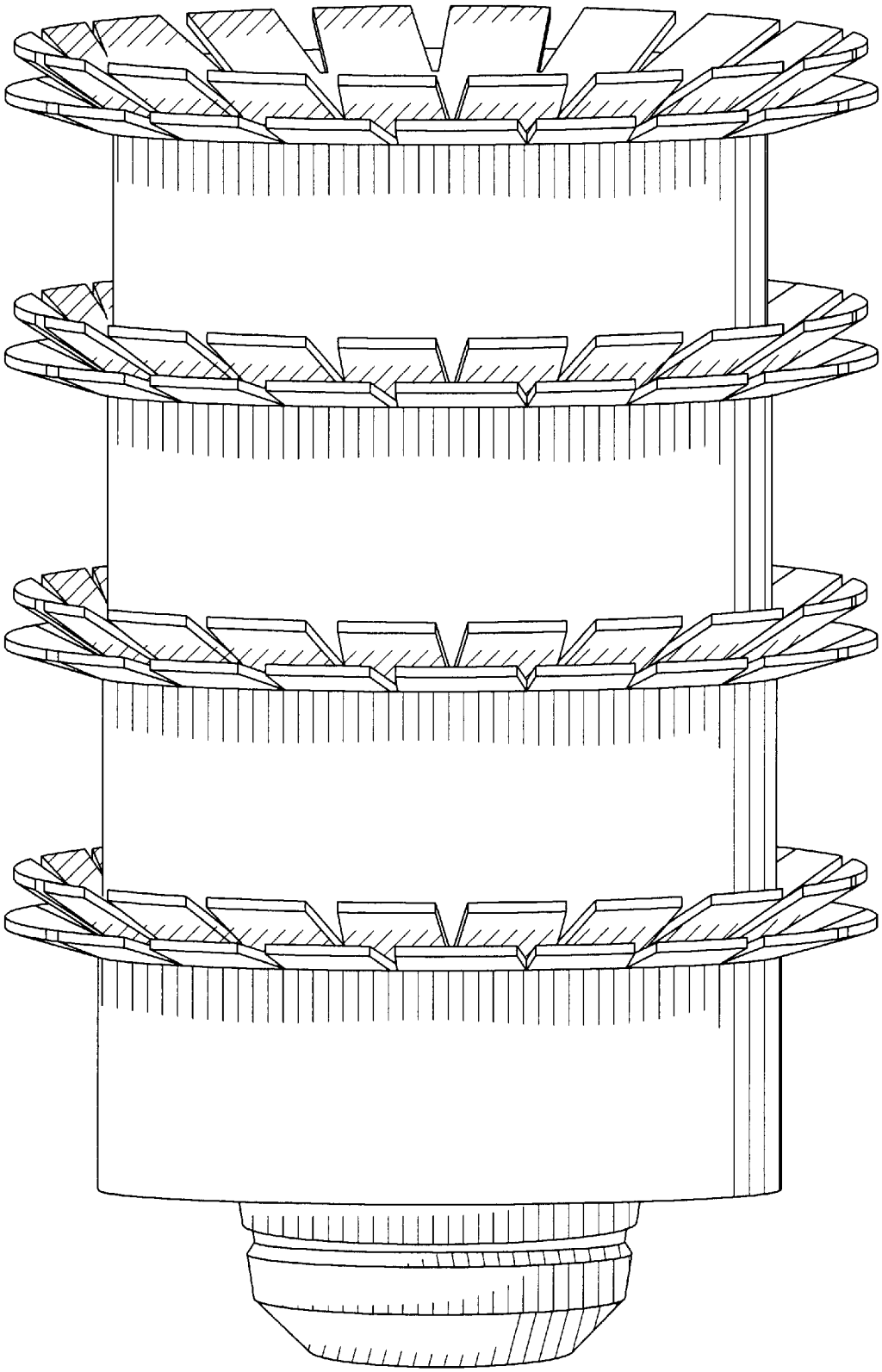
FIG. 5 is a side elevation of the bottom plug shown in FIG. 3 with its nose seal removed.

Referring now to FIG. 2 there is shown a known bottom plug 101. The bottom plug 101 is in many ways similar to the top plug 1 and parts having similar functions have been identified by similar reference numerals in the 100 series.

The bottom plug 101 differs from the top plug 1 in that the top surface 106 is provided with an anti-rotation device in the form of a female socket 114 having a shape which is complimentary to the tapered male member 7.

In addition, the cavity 113 extends the full axial length of the bottom plug 101 and is provided with a removable bursting disk 115. It will be noted that the bursting disk 115 is disposed near the upstream end of the bottom plug 101.

The top plug 1 and the bottom plug 101 together form a plug set which can be used in a cementing operation.

In use, after a borehole has been drilled in the ground casing is lowered into the borehole. A float shoe is placed in or near the bottom of the casing as it is lowered.

After the casing has been lowered mud is pumped down the casing and allowed to flow upwardly through the annular space between the casing and the borehole to remove debris and clean the surface of the casing. When this process is complete the bottom plug 101 is introduced into the casing and the required volume of cement pumped into the casing above the plug. The cement displaces the bottom plug 101 downwardly into the casing. When the calculated volume of cement has been introduced the top plug 1 is introduced into the casing and the column of cement bounded by the bottom plug 101 and top plug 1 are pumped down the casing by pumping mud into the casing above the top plug 1.

When the bottom plug 101 lands on the float shoe (not shown) pressure is increased on the top plug 1 until the bursting disk ruptures allowing the cement to flow down the inside of the casing and then outwardly and upwardly into the annular space between the casing and the borehole.

When the top plug 1 lands on the bottom plug 101 cementation is complete. The pressure of the drilling mud is then increased to a desired test pressure and the pumps stopped. The pressure drop is then noted to check that any leakage from the casing is within acceptable limits. The pressure in the casing is then relaxed and the cement allowed to set before the top plug 1, bottom plug 101, float shoe and surplus cement are drilled out.

It will be noted that during the pressure test the entire downward load is exerted on the top 6 of the top plug 1. This load is transmitted through the core 2 to the bottom plug 101 and then to the float shoe (not shown). For this reason the top plug 1 and bottom plug 101 are of extremely robust construction.

Referring now to FIG. 3 there is shown a plug set in accordance with the present invention. The plug set, which is generally identified by reference numeral 200 comprises a top plug 201 and a bottom plug 301.

The top plug 201 comprises a modular body 202 comprising three identical modules 202*a,* 202*b* and 202*c* which are secured together by adhesive, although they could also be affixed to one another by, for example, ultrasonic welding or even merely clipped together.

The top plug 201 also comprises a downstream module 207 having a tapered nose 208 provided with an o-ring seal 209.

Each module 202*a,* 202*b,* 202*c,* 207 is provided with an upper fin and a lower fin. Since the fin detail for each module is identical only the fin arrangement on module 201*a* will be described.

In particular, module 201*a* comprises a ring 203 provided with an upper fin 216 which projects radially outwardly from the ring 203. As can be seen in FIG. 4, the upper fin 216 comprises a plurality of segments two of which 216*a* and 216*b* have been specifically identified in FIG. 4. The segments 216 define therebetween a plurality of gaps, gap 217 being specifically identified between segments 216*a* and 216*b*.

The ring 203 is also provided with a lower fin 218 which also comprises a plurality of segments which are disposed below the segments 216 but offset circumferentially relative thereto. As can be seen from FIG. 1, the lower fins 218 are longer than the upper fins 216. In addition, on careful inspection of FIG. 3 it can be seen that the inner extremity of the lower fin 218 is set radially inwardly into the ring 203 more that inner extremity of the upper fin 216. The radial outer extremity of the lower fin 218 and the lower surface of the lower fin 218 adjacent thereto are provided with a plurality of ribs 219 to facilitate removal of mud cake.

The modules 202*a,* 202*b* and 202*c* are made by injection moulding.

The module 207 is also made by injection moulding and has an upwardly convex bottom and a reinforcing member 220.

The bottom plug 301 is of generally similar construction to the top plug 201 and parts having similar functions have been identified by similar reference numerals in the 300 series.

The main difference to note is that the top plug 201 can nest in the bottom plug 301.

Relative to the prior art shown in FIGS. 1 and 2 it will be noted that the top plug 201 and the bottom plug 301 are both hollow and have no core similar to core 2. Such a core is unnecessary.

Figure 6:
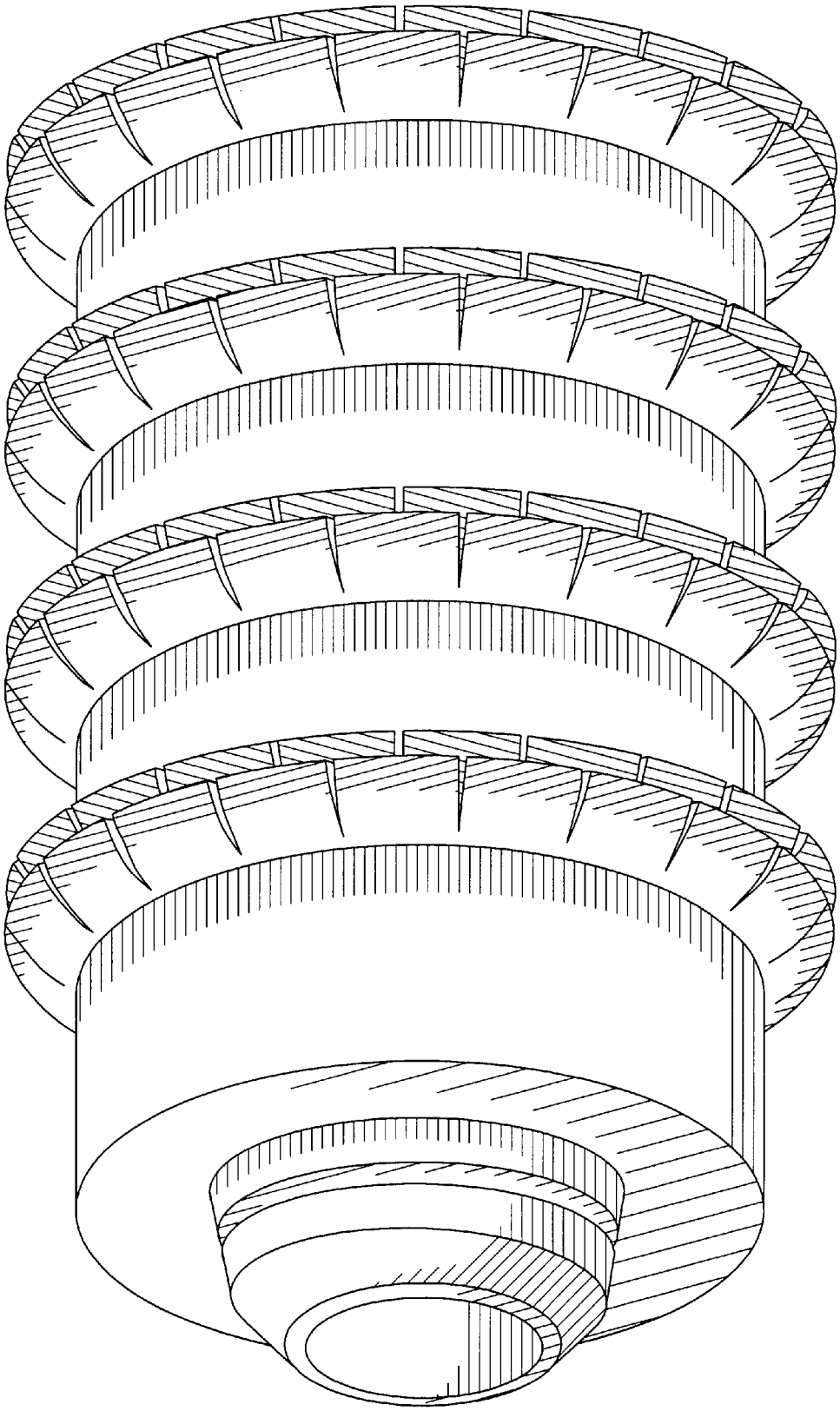
FIG. 6 is a side elevation of the bottom plug shown in FIG. 3 in a length of casing.
Figure 7:
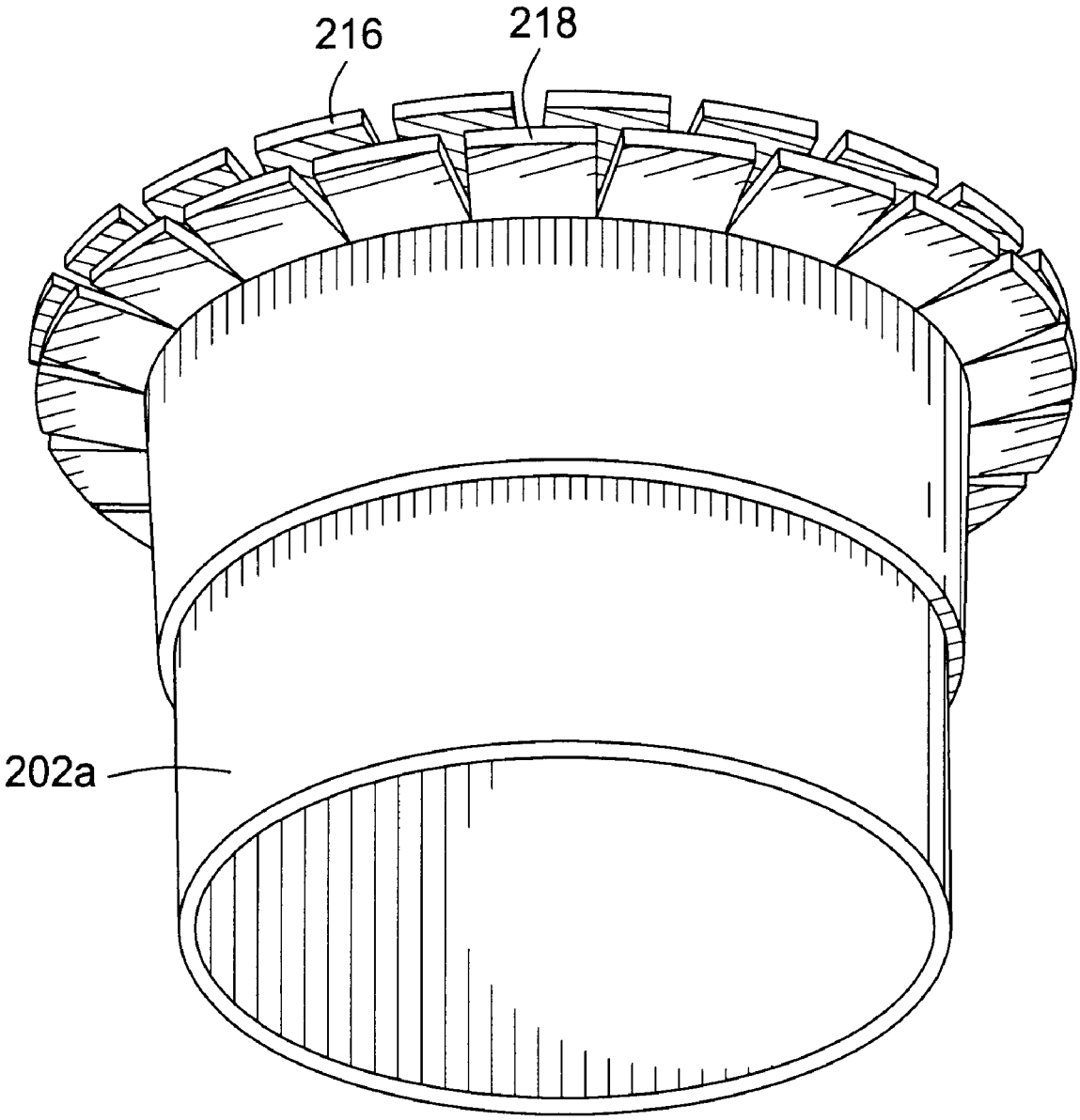
FIG. 7 is a perspective view of a module used in the construction of the top plug shown in FIG. 3.

In particular, in use, after circulation the bottom plug 301 is inserted into the casing. As it is inserted the lower and upper fins 218, 216 are bent upwardly and the upper surface of the lower fins 218 presses against the lower surface of the upper fins 216 (FIG. 6).

It should be understood that whilst this provides an adequate seal for pumping down the cement it is not intended to withstand casing test pressure and, indeed, is not required so to do.

The ribs on the lower fins 218 are extremely useful in removing mud cake which inevitably seems to build up on the inside wall of the casing during the circulation preceding cementation.

The cement is then pumped down the well between bottom plug 301 and top plug 201. Because the cement is acting on the bursting disk 315 the bottom plug 301 travels down the casing with minimal wobble and lands on a float shoe (not shown). The tapered nose 308 enters a correspondingly tapered entrance to the float shoe and o-ring 309 forms a seal therebetween.

When sufficient pressure is applied to the top plug 202 the bursting disk 315 ruptures allowing cement to pass through the float shoe, around the bottom of the casing and up into the annular space between the outside of the casing and the borehole.

Since the top plug 201 is hollow the mud pumping it downhole acts on the flow of the module 207 helping to minimise wobble. As it approaches the float shoe the top plug 201 enters and passes downwardly inside the bottom plug 201 until it comes to rest with its tapered nose 208 inside the tapered nose 308 of the bottom plug 201, sealing therebetween being effected by o-ring 209. As the top plug 201 enters the bottom plug 301 the fins bend upwardly and are accommodated in the annular space between the top plug 201 and the bottom plug 301.

As soon as the top plug 201 lands the pressure is increased to the level required to test the casing. it will be noted that the downward thrust is transmitted through the bases of modules 207 and 307 so that the construction of the modules 202*a,* 202*b,* 202*c* and 302*a,* 302*b* and 302*c* can be relatively light.

After pressure testing the pressure in the casing is relaxed and the cement allowed to set. When the drill is subsequently lowered there is no question of having to bore out cores similar to core 2. Instead, the base of the top plug 201 and 301 offer minimal resistance and the drill simply has to drill away the float shoe and residual cement in the casing therebelow before extending the well.

Various modifications to the embodiment described are envisaged, for example the upper and lower fins 216, 218 could conceivably be replaced by a single fin having segments with parts which overlap so that when the plug is placed in a tubular the segments form a complete inverted skirt inside the casing.

In certain circumstances it is desirable to use one or more intermediate plugs. For example, it may be desirable to insert a bottom plug into a casing, introduce a volume of an isolating liquid into the casing, insert an intermediate plug above such isolating liquid and then introduce the cement above the intermediate plug. Similarly, it may be desirable to insert an intermediate plug above the cement, insert a further volume of isolating liquid and then insert the top plug. In such arrangements the intermediate plug will have a construction similar to the bottom plug except that the plugs will be sized to nest in one another.

It will be appreciated that for nesting purposes it is not essential for the top plug to be hollow although this is clearly desirable for the reasons disclosed above.

By adopting a modular construction the cost of providing the required moulds can be minimised. In this connection it is contemplated that the modules 207 and 307 might be manufactured using a module similar to modules 202 and 302 and simply securing an appropriate base unit thereto.

What is claimed is:

1. A plug for use in a wellbore, said plug comprising a body and at least a first fin which is made of resilient material and which projects radially outwardly from said body to engage, in use, the inner wall of a tubular, said first fin being segmented wherein a gap is formed between adjacent segments and provided with means to inhibit liquid passing through the gaps between said segments characterized in that the inhibiting means comprises a second fin which is disposed downstream of said first fin and which is segmented in such a way that, in use, the segments in said second fin engage said segments in said first fin and overlap the gap therebetween.

2. A plug as claimed in claim 1, wherein the segments of the first fin are mounted to pivot about a line which is disposed radially outwardly of a line for about which the segments of said second fin pivot.

3. A plug as claimed in claim 1, wherein the radial-extremities of the segments of the second fin are provided with means which, in use, facilitate the removal of mud cake from the inside of said casing.

4. A plug as claimed in claim 1, wherein said body, said at least one fin, and said second fin are manufactured by injection moulding.

5. A plug as claimed in claim 1, wherein said body comprises at least two identical modules secured together.

6. A plug as claimed in claim 5, wherein said modules are secured together by clips which interengage when one module is pushed into another and which inhibit subsequent separation of said modules.

7. A plug as claimed in claim 5, wherein said modules are formed by injection moulding.

8. A plug set for use in a wellbore, said plug set having an upstream end and a downstream end, comprising a top plug and a bottom plug, wherein said bottom plug is mostly hollow along its longitudinal length and said top plug can be accommodated therein and wherein a portion of said top plug is mostly hollow along its longitudinal length and said portion is open to the upstream end of said top plug.

9. A plug set as claimed in claim 8 wherein said plug set is manufactured by injection moulding.

10. A plug set as claimed in claim 8, wherein said plug set comprises at least two identical modules secured together.

11. A plug set as claimed in claim 10, wherein said modules are secured together by clips which interengage when one module is pushed into another and which inhibit subsequent separation of said modules.

12. A plug set as claimed in claim 10, wherein said modules are formed by injection moulding.

13. A plug set for use in a wellbore, said plug set having an upstream end and a downstream end, comprising a top plug and a bottom plug, wherein said bottom plug is mostly hollow along its longitudinal length and said top plug can be accommodated therein and wherein said top plug is hollow along its longitudinal length and open to the upstream end of said top plug.

14. A plug set for use in a wellbore, said plug set having an upstream end and a downstream end, comprising a top plug and a bottom plug, wherein said bottom plug is mostly hollow along its longitudinal length and said top plug can be accommodated therein and wherein the downstream end of said bottom plug is provided with a seat and a nose which can be received within a float shoe or float collar.

15. A plug set as claimed in claim 14, wherein said nose is tapered.

16. A plug set as claimed in claim 14, wherein said nose is provided with a seal for sealing engagement with a float shoe or float collar.

17. A plug set as claimed in claim 14, wherein the downstream end of said top plug is provided with a tapered nose that mates with the seat of said bottom plug.

18. A plug set as claimed in claim 17, wherein the tapered nose of said top plug is provided with a seal to seal against the seat of said bottom plug.

19. A plug for use in wellbore operations comprising:

a ring shaped body having a first portion with a first inner diameter and a second portion with a second inner diameter;

an upper fin and a lower fin on the first portion of the ring shaped body.

20. A plug according to claim 19, wherein the first inner diameter of the first portion of the ring shaped body is uniform along a longitudinal length of the first portion of the ring shaped body.

21. A plug according to claim 19, wherein the second inner diameter of the second portion of the ring shaped body is uniform along a longitudinal length of the second portion of the ring shaped body.

22. A plug according to claim 19, wherein the first inner diameter is larger than the second inner diameter.

23. A plug according to claim 19, further comprising a plurality of identically shaped, ring shaped bodies secured together wherein the second portion of at least one ring shaped body fits within the first portion of an adjacent ring shaped body.

24. A plug according to claim 23, wherein at least one of the plurality of ring shaped bodies further comprises a tapered nose and sealing means.

25. A plug according to claim 23, wherein the secured together plurality of ring shaped bodies is a top plug, bottom plug or intermediate plug.

26. A plug according to claim 25, wherein the ring shaped bodies are formed by injection moulding.

27. A plug according to claim 23, wherein the plurality of identically shaped, ring shaped bodies are secured together by adhesive, ultrasonic welding or clips.

28. A plug according to claim 23, wherein the plurality of ring shaped bodies are produced in one piece by injection moulding.

29. A plug according to claim 19, wherein the lower fin comprises one or more ribs.

30. A plug for use in wellbore operations, comprising:

an annular body having a first portion with a first inner diameter, a second portion with a second inner diameter;

an upper fin and a lower fin on the first portion of the annular body, wherein the lower fin is set radially inwardly on the annular body more than the inner radial extremity of the upper fin on the annular body.

31. A plug according to claim 30, wherein the lower fin is longer than the upper fin.

32. A plug according to claim 30, wherein the radial outer extremity of the lower fin and the lower surface of the lower fin are provided with a plurality of ribs.

33. A plug according to claim 30, wherein the upper fin and the lower fin are segmented into a plurality of segments such that a gap exists between adjacent segments.

34. A plug according to claim 33, wherein the gaps between adjacent segments in the upper fin are off set circumferentially relative to the gaps between adjacent segments in the lower fin.

35. A plug according to claim 30, wherein the annular body is formed by injection moulding.

36. A plug according to claim 30, wherein the upper fin and the lower fin are less than 3 mm thick.

37. A plug according to claim 30, wherein the annular body is formed from a polyamide.

* * * * *